US011401484B2

(12) United States Patent
Rodriguez Cedillo et al.

(10) Patent No.: US 11,401,484 B2
(45) **Date of Patent: *Aug. 2, 2022**

(54) CLEANING COMPOSITIONS AND METHODS FOR MODIFYING TURBIDITY AND ENHANCING FRAGRANCE PERFORMANCE

(71) Applicant: Colgate-Palmolive Company, New York, NY (US)

(72) Inventors: Cesar Rodriguez Cedillo, Naucalpan de Juarez (MX); Carlos Munoz Carrillo, Del Miguel Hidalgo (MX); Luis Javier Rivera Cruz, Mexico City (MX); Jose Bucio, Guanajuato (MX)

(73) Assignee: Colgate-Palmolive Company, New York, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/472,284

(22) PCT Filed: Dec. 18, 2017

(86) PCT No.: PCT/US2017/067136

§ 371 (c)(1),
(2) Date: Jun. 21, 2019

(87) PCT Pub. No.: WO2018/125648

PCT Pub. Date: Jul. 5, 2018

(65) Prior Publication Data

US 2019/0376004 A1 Dec. 12, 2019

Related U.S. Application Data

(60) Provisional application No. 62/439,235, filed on Dec. 27, 2016.

(51) Int. Cl.

| | |
|---|---|
| ***C11D 1/83*** | (2006.01) |
| ***B08B 1/00*** | (2006.01) |
| ***B08B 3/08*** | (2006.01) |
| ***C11D 3/04*** | (2006.01) |
| ***C11D 3/20*** | (2006.01) |
| ***C11D 3/50*** | (2006.01) |
| ***C11D 17/00*** | (2006.01) |
| *C11D 1/14* | (2006.01) |
| *C11D 1/22* | (2006.01) |
| *C11D 1/72* | (2006.01) |

(52) U.S. Cl.
CPC ..... *C11D 1/83* (2013.01); *B08B 1/006* (2013.01); *B08B 3/08* (2013.01); *C11D 3/046* (2013.01); *C11D 3/2086* (2013.01); *C11D 3/50* (2013.01); *C11D 17/0008* (2013.01); *C11D 1/146* (2013.01); *C11D 1/22* (2013.01); *C11D 1/721* (2013.01)

(58) Field of Classification Search
CPC ..... C11D 1/83; C11D 1/22
See application file for complete search history.

(56) References Cited

U.S. PATENT DOCUMENTS

| | | | | |
|---|---|---|---|---|
| 6,194,362 | B1 | 2/2001 | Trinh et al. | |
| 6,462,010 | B1 | 10/2002 | Aszman et al. | |
| 7,939,488 | B2 | 5/2011 | Scheuing et al. | |
| 2009/0143274 | A1* | 6/2009 | Benes | C11D 1/22 510/492 |
| 2010/0234269 | A1 | 9/2010 | Dreilinger et al. | |
| 2012/0046214 | A1* | 2/2012 | Braeckman | C11D 1/94 510/235 |
| 2015/0264922 | A1 | 9/2015 | Scheuing et al. | |
| 2015/0275148 | A1* | 10/2015 | Joiner | C11D 1/83 510/393 |
| 2018/0201877 | A1 | 7/2018 | Maldonado Ortega et al. | |

FOREIGN PATENT DOCUMENTS

WO 2017/010971 1/2017

OTHER PUBLICATIONS

International Search Report and Written Opinion of the International Searching Authority in International Application No. PCT/US2017/067136, dated Mar. 19, 2018.

* cited by examiner

*Primary Examiner* — Necholus Ogden, Jr.

(57) ABSTRACT

Disclosed are cleaning compositions including at least two anionic surfactants, such as a mixture of a linear alkylbenzene sulfonate (LAS) and a sodium lauryl ether sulfate (SLES), wherein the mixture is present in the cleaning composition in a total amount combined of LAS and SLES of about 1%-2% by weight and wherein a weight ratio of LAS:SLES is about 3:1 to about 1:1 or about 6:1 to about 4:1; an ionic agent in an amount of about 0.01% to about 0.5% by weight, a nonionic surfactant in an amount of greater than about 0% to less than about 0.45% by weight, and a fragrance. Methods of preparing and using the present cleaning compositions are also disclosed.

13 Claims, No Drawings

CLEANING COMPOSITIONS AND METHODS FOR MODIFYING TURBIDITY AND ENHANCING FRAGRANCE PERFORMANCE

CROSS-REFERENCE TO RELATED APPLICATIONS

This application claims priority to U.S. Provisional Patent Application No. 62/439,235, filed 27 Dec. 2016, which is incorporated herein by reference.

BACKGROUND

Fragrance is a key performance characteristic of cleaning compositions. When consumers compare two cleaning products, such as bucket-dilutable cleaners, that have the same base formula but different fragrances, they often rate the product that has the more pleasant fragrance as a better cleaner. Consumers may also rate products with a more intense and/or longer-lasting fragrance as a better cleaner.

Two cleaning compositions containing the same amount and type of fragrance, however, may not have the same fragrance performance (e.g., hedonic tone, release, long lastingness). Specific formula components such as surfactants, polymers and salts, for example, can interact with and impact fragrance performance. The traditional approach used to address any negative impact resulting from the interaction between formula ingredients and fragrance components has been to modify the composition of the fragrance to compensate for shortcomings in fragrance performance driven by the formula. However, depending upon cost and availability, modifying the composition of a fragrance, such as increasing the amount, may not be cost-effective or feasible. Accordingly, there is a desire in the art to increase fragrance performance in cleaning compositions without modifying the composition of a fragrance.

BRIEF SUMMARY

The present disclosure provides a turbidity-modified, fragrance-enhanced cleaning composition. In an implementation, such a cleaning composition comprises: at least two anionic surfactants, wherein the at least two anionic surfactants comprise a linear alkylbenzene sulfonate (LAS) and a sodium lauryl ether sulfate (SLES), wherein the LAS and the SLES are present in the cleaning composition in a total amount combined of about 1%-2% by weight and wherein a weight ratio of LAS:SLES is about 3:1 to about 1:1 or about 6:1 to about 4:1; an ionic agent in an amount of about 0.01% to about 0.5% by weight; a nonionic surfactant in an amount of greater than about 0% to less than about 0.45% by weight; and a fragrance.

In an implementation of the cleaning compositions disclosed herein, the cleaning composition is a bucket-dilutable cleaning composition.

In an implementation of any of the disclosed cleaning compositions, the LAS:SLES ratio is about 3:1.

In an implementation of any of the disclosed cleaning compositions, the fragrance is present in the cleaning composition in an amount of about 0.5% to about 2% by weight.

In an implementation of any of the disclosed cleaning compositions, the nonionic surfactant is a C9-C11 alkanol condensed with 2.5 to 10 moles of ethylene oxide.

In an implementation of any of the disclosed cleaning compositions, the nonionic surfactant is C9-C11 Pareth 8.

In an implementation of any of the disclosed cleaning compositions, the cleaning composition has a turbidity of greater than 10 NTU.

In an implementation of any of the disclosed cleaning compositions, the ionic agent is present in the composition in an amount of about 0.2% to about 0.3% by weight.

In an implementation of any of the disclosed cleaning compositions, the ionic agent comprises a metal salt electrolyte.

In an implementation of any of the disclosed cleaning compositions, the ionic agent comprises sodium chloride.

In an implementation of any of the disclosed cleaning compositions, the ionic agent comprises a metal acid.

In an implementation of any of the disclosed cleaning compositions, the ionic agent comprises sodium citrate.

Also provided herein is a method of preparing a cleaning composition with modified turbidity and enhanced fragrance performance. In an implementation, a method of preparing such a cleaning composition comprises: combining at least two anionic surfactants, wherein the at least two anionic surfactants comprise a linear alkylbenzene sulfonate (LAS) and a sodium lauryl ether sulfate (SLES), to form a mixture having a weight ratio of LAS:SLES of about 3:1 to about 1:1 or about 6:1 to about 4:1; and adding the mixture, an ionic agent and a nonionic surfactant to the cleaning composition, wherein the cleaning composition includes a fragrance, wherein the mixture comprises a total amount combined of LAS and SLES of about 1%-2% by weight of the cleaning composition, and wherein the ionic agent comprises an amount of about 0.01% to about 0.5% by weight and the nonionic surfactant comprises an amount of greater than about 0% to less than about 0.45% by weight of the cleaning composition.

In an implementation of a method of preparing a cleaning composition, the nonionic surfactant is a C9-C11 alkanol condensed with 2.5 to 10 moles of ethylene oxide.

In an implementation of any of the disclosed methods of preparing a cleaning composition, the nonionic surfactant is C9-C11 Pareth 8.

In an implementation of any of the disclosed methods of preparing a cleaning composition, the cleaning composition has a turbidity of greater than 10 NTU.

In an implementation of any of the disclosed methods of preparing a cleaning composition, the fragrance is present in the cleaning composition in an amount of about 0.5 to about 2.0% by weight.

In an implementation of any of the disclosed methods of preparing a cleaning composition, the cleaning composition is a bucket-dilutable cleaning composition.

Also provided herein is a method of cleaning a substrate, the method comprising: applying any one of the compositions disclosed herein to the substrate; and wiping the cleaning composition across the substrate.

In an implementation of a method of cleaning a substrate, the cleaning composition is a bucket-dilutable cleaner.

Further areas of applicability of the present disclosure will become apparent from the detailed description provide d hereinafter. It should be understood that the detailed description and specific examples, while indicating the typical aspect of the disclosure, are intended for purposes of illustration only and are not intended to limit the scope of the disclosure.

DETAILED DESCRIPTION

The following description of the typical implementations is merely exemplary in nature and is in no way intended to limit the disclosure, its application, or uses.

As used throughout, ranges are used as shorthand for describing each and every value that is within the range. Any value within the range can be selected as the terminus of the range. In addition, all references cited herein are hereby incorporated by reference in their entireties. In the event of a conflict in a definition in the present disclosure and that of a cited reference, the present disclosure controls.

Unless otherwise specified, all percentages and amounts expressed herein and elsewhere in the specification should be understood to refer to percentages by weight. The amounts given are based on the active weight of the material.

Cleaning Compositions

The present disclosure is directed to cleaning compositions with enhanced fragrance performance. As described herein, fragrance performance is enhanced in the present cleaning compositions by modifying the amount and/or ratio of specific anionic surfactants in the formulation as described herein. Accordingly, in some implementations, the cleaning compositions of the instant disclosure provide enhanced fragrance performance, without the need to increase or change the amount of fragrance.

As used herein, a "cleaning composition" is any composition that may be useful in cleaning substrates, such as household surfaces. A "surface" refers to the surface of any appliance or fixture, and may include hard surfaces such as counters, sinks, cabinets, walls, the surfaces of appliances such as kitchen appliances (e.g., stoves, conventional or microwave ovens, refrigerators, dishwashers and the like), or bathroom appliances and fixtures (e.g., sinks, toilets, bathtubs, tiles, shower curtains and doors), wood or glass surfaces, floors, utensils or dishes, as well as furniture or clothing (including carpets or rugs, cloths, bedding, leather, sponges and mops, polymeric or fabric surfaces or objects made from natural or synthetic materials, e.g., protective gear or sports equipment). Accordingly, the present compositions may be formulated into hard surface cleaners, spray cleaners, floor cleaners, microwave cleaners, stove top cleaners, etc.

The cleaning compositions of the present disclosure may be in the form of a bucket-dilutable cleaner. As used herein, "bucket-dilutable" refers to a cleaning composition that may be (but does not necessarily have to be) diluted with water, for example, in a bucket or other container, prior to use.

In some implementations, the cleaning compositions of the present disclosure comprise at least two anionic surfactants, typically, a linear alkylbenzene sulfonate (also referred to herein as LAS) and a sodium lauryl ether sulfate (also referred to herein as SLES).

Anionic Surfactants

Linear Alkylbenezne Sulfonate

In various implementations, the linear alkylbenzene sulfonate has a higher content of 3-phenyl (or higher) isomers and a correspondingly lower content (below 50%) of 2-phenyl (or lower) isomers, such as those sulfonates wherein the benzene ring is attached mostly at the 3 or higher (for example 4, 5, 6 or 7) position of the alkyl group and the content of the isomers in which the benzene ring is attached in the 2 or 1 position is correspondingly low. Suitable linear alkylbenzene sulfonates that can be used in the present cleaning compositions include those in which the alkyls have 10 to 13 carbon atoms. Other suitable linear alkylbenzene sulfonates are found in U.S. Pat. No. 3,320,174, which is herein incorporated by reference in its entirety. Typically, the linear alkylbenzene sulfonate of the present cleaning compositions is sodium dodecyl benzene sulfonate.

Sodium Lauryl Ether Sulfate

In various implementations, the present cleaning compositions contain sodium lauryl ether sulfate, also known as sodium laureth sulfate. In one implementation, the sodium lauryl ether sulfate has an average of about 1 to about 10 moles of ethylene oxide per mole. In another implementation, there is an average of about 2 to about 3 moles of ethylene oxide per mole.

In some implementations, the anionic surfactants, for example, a combination of LAS and SLES, are present in the instant cleaning compositions in ratios and amounts that enhance the fragrance performance of the compositions in comparison to a reference cleaning composition as described herein. In other implementations, the anionic surfactants, for example, a combination of LAS and SLES, are present in the instant cleaning compositions in ratios and amounts that diminish the fragrance performance of the cleaning compositions in comparison to a reference cleaning composition as also described herein.

In some implementations, the cleaning compositions of the present disclosure contain a total amount of anionic surfactant, such as a total amount of LAS and SLES combined, of about 0.1% to about 3.5% by weight, about 0.5% to about 2%, about 0.8% to about 1.5%, about 1% to about 2%, about 1.0% to about 1.3%, and about 1.6 to about 1.7%.

In some implementations, the ratio of LAS to SLES ranges from about 6:1 to about 1:0, such as about 5:1 to about 1:1, about 4:1 to about 1:1, about 3:1 to about 1:1 and about 2:1 to about 1:1. More typically, the ratio of LAS to SLES ranges from about 3:1 to about 1:1 or about 6:1 to about 4:1.

In some implementations, a cleaning composition of the instant disclosure contains a total amount of LAS and SLES of about 1%-2% by weight, wherein the LAS:SLES is present in the composition at a ratio of about 4:1. In various implementations, this amount and ratio results in an increase in fragrance performance in comparison to a standard, such as a reference cleaning composition containing the same amount and type of fragrance as the present cleaning composition, but wherein the LAS and SLES are present in the reference cleaning composition in a total amount of about 1%-2% by weight at an LAS:SLES ratio of about 3.33:1.

In some implementations, a cleaning composition of the instant disclosure contains a total amount of LAS and SLES of about 1%-2%, wherein the LAS:SLES is present in the composition at a ratio of about 2.3:1. In various implementations, this amount and ratio results in an increase in fragrance performance in comparison to a standard, such as a reference cleaning composition, containing the same amount and type of fragrance as the present cleaning composition, but wherein the LAS and SLES are present in the reference cleaning composition in a total amount of about 1%-2% by weight at an LAS:SLES ratio of about 3.33:1.

In some implementations, a cleaning composition of the instant disclosure contains a total amount of LAS and SLES of about 1%-2%, wherein the LAS:SLES is present in the composition at a ratio of about 1:1. In various implementations, this amount and ratio results in an increase in fragrance performance in comparison to a standard, such as a reference cleaning composition, containing the same amount and type of fragrance as the present cleaning composition, but wherein the LAS and SLES are present in the reference cleaning composition in a total amount of about 1%-2% by weight at an LAS:SLES ratio of about 3.33:1.

In some implementations, a cleaning composition of the instant disclosure contains a total amount of LAS and SLES of about 1%-2%, wherein the LAS:SLES is present in the composition at a ratio of about 3:1. In various implementations, this amount and ratio results in an increase in fragrance performance in comparison to a standard, such as a reference cleaning composition containing the same amount and type of fragrance as the present cleaning composition, but wherein the LAS and SLES is present in the reference cleaning composition in a total amount of about 1%-2% by weight at an LAS:SLES ratio of about 3.33:1.

Nonionic Surfactant

In some implementations, the present cleaning composition further contains a nonionic surfactant. Suitable nonionic surfactants include water soluble nonionic surfactants, which are commercially well known and include the primary aliphatic alcohol ethoxylates, secondary aliphatic alcohol ethoxylates, alkylphenol ethoxylates and ethylene-oxide propylene oxide condensates on primary alkanols, such a PLURAFAC™ surfactants and condensates of ethylene oxide with sorbitan fatty acid esters such as the TWEEN™ surfactants. More typically, nonionic surfactants are chosen from primary alcohol ethoxylates, such as C9 to C11 alcohols. Exemplary C9 to C11 alcohol ethoxylates may include NEODOL® 91-8, also known as C9-C11 Pareth 8, a polyethylene glycol ether with an average of 8 moles of ethylene oxide per mole of alcohol. Other suitable nonionic surfactants are described in International Publication WO 2007/001593 to Simon et al. and U.S. Pat. No. 6,342,473 to Kott et al., herein incorporated by reference in their entireties. In various implementations, the nonionic surfactant is present in amounts of from greater than about 0% to less than about 0.45%, about 0.01% to about 0.44%, about 0.05% to about 0.40%, for example, about 0.2% to about 0.35%, including 0.25% to about 0.35%, typically about 0.35%, more typically, about 0.4%, such as 0.35%-0.45% by weight of the cleaning composition.

Fragrance

In some implementations, the present cleaning composition contains one or more fragrances. As used herein the term "fragrance" is used in its ordinary sense to refer to and include any fragrant substance or mixture of substances including natural (i.e., obtained by extraction of flower, herb, blossom or plant), and/or artificial (i.e., mixture of natural oils or oil constituents and/or synthetically produced substances) odoriferous substances. Typically, fragrances are complex mixtures or blends of various organic compounds such as alcohols, aldehydes, esters, and varying amounts of essential oils. Suitable fragrances include those sold under tradename HALOSCENT® available from Firmenich, and may include those fragrances having a higher degree of hydrophobicity such that they are difficult to emulsify and those fragrances having a lower degree of hydrophobicity (i.e., higher hydrophilicity) such that they are more soluble in water.

Suitable alcohols which may be used in a fragrance include farnesol, geraniol, linalool, nerol, phenylethyl alcohol, rhodinol, cinnamic alcohol, (Z)-hex-3-en-1-ol, menthol, α-terpineol. Suitable aldehydes include citral, α-hexyl cinnamaldehyde, Lilial, methylionone, verbenone, nootkatone, geranylacetone. Suitable esters include allyl phenoxyacetate, benzyl salicylate, cinnamyl propionate, citronellyl acetate, decyl acetate, dimethylbenzylcarbinyl acetate, dimethylbenzylcarbinyl butyrate, ethyl acetoacetate, cis-3-hexenyl isobutyrate, cis-3-hexenyl salicylate, linalyl acetate, methyl dihydrojasmonate, styralyl propionate, vetiveryl acetate, benzyl acetate, geranyl acetate.

Suitable essential oils include Anethole 20/21 natural, Aniseed oil china star, Aniseed oil globe brand, Balsam (Peru), Basil oil (India), Black pepper oil, Black pepper oleoresin 40/20, Bois de Rose (Brazil) FOB, Borneol Flakes (China), Camphor oil, Camphor powder synthetic technical, Cananga oil (Java), Cardamom oil, Cassia oil (China), Cedarwood oil (China) BP, Cinnamon bark oil, Cinnamon leaf oil, Citronella oil, Clove bud oil, Clove leaf, Coriander (Russia), Coumarin (China), Cyclamen Aldehyde, Diphenyl oxide, Ethyl vanilin, Eucalyptol, Eucalyptus oil, Eucalyptus citriodora, Fennel oil, Geranium oil, Ginger oil, Ginger oleoresin (India), White grapefruit oil, Guaiacwood oil, Gurjun balsam, Heliotropin, Isobornyl acetate, Isolongifolene, Juniper berry oil, L-methyl acetate, Lavender oil, Lemon oil, Lemongrass oil, Lime oil distilled, Litsea Cubeba oil, Longifolene, Menthol crystals, Methyl cedryl ketone, Methyl chavicol, Methyl salicylate, Musk ambrette, Musk ketone, Musk xylol, Nutmeg oil, Orange oil, Patchouli oil, Peppermint oil, Phenyl ethyl alcohol, Pimento berry oil, Pimento leaf oil, Rosalin, Sandalwood oil, Sandenol, Sage oil, Clary sage, Sassafras oil, Spearmint oil, Spike lavender, Tagetes, Tea tree oil, Vanilin, Vetyver oil (Java), Wintergreen, Allocimene, ARBANEX™, ARBANOL®, Bergamot oils, Camphene, Alpha-Campholenic aldehyde, I-Carvone, Cineoles, Citral, Citronellol Terpenes, Alpha-Citronellol, Citronellyl Acetate, Citronellyl Nitrile, Para-Cymene, Dihydroanethole, Dihydrocarveol, d-Dihydrocarvone, Dihydrolinalool, Dihydromyrcene, Dihydromyrcenol, Dihydromyrcenyl Acetate, Dihydroterpineol, Dimethyloctanal, Dimethyloctanol, Dimethyloctanyl Acetate, Estragole, Ethyl-2 Methylbutyrate, Fenchol, FERNLOL™, FLORILYS™, Geraniol, Geranyl Acetate, Geranyl Nitrile, GLIDMINT™, Mint oils, GLIDOX™, Grapefruit oils, trans-2-Hexenal, trans-2-Hexenol, cis-3 -Hexenyl Isovalerate, cis-3 -Hexanyl -2-methylbutyrate, Hexyl Isovalerate, Hexyl-2-methylbutyrate, Hydroxycitronellal, Ionone, Isobornyl Methylether, Linalool, Linalool Oxide, Linalyl Acetate, Menthane Hydroperoxide, I-Methyl Acetate, Methyl Hexyl Ether, Methyl-2-methylbutyrate, 2-Methylbutyl Isovalerate, Myrcene, Nerol, Neryl Acetate, 3-Octanol, 3-Octyl Acetate, Phenyl Ethyl-2-methylbutyrate, Petitgrain oil, cis-Pinane, Pinane Hydroperoxide, Pinanol, Pine Ester, Pine Needle oils, Pine oil, alpha-Pinene, beta-Pinene, alpha-Pinene Oxide, Plinol, Plinyl Acetate, Pseudo Ionone, Rhodinol, Rhodinyl Acetate, Spice oils, alpha-Terpinene, gamma-Terpinene, Terpinene-4-OL, Terpineol, Terpinolene, Terpinyl Acetate, Tetrahydrolinalool, Tetrahydrolinalyl Acetate, Tetrahydromyrcenol, TETRALOL®, Tomato oils, Vitalizair, ZESTORAL™, HINOKITIOL™ and THUJOPSIS DOLABRATA™. Additionally, some suitable fragrances may be supplied by the fragrance houses as mixtures in the form of proprietary specialty accords.

The amount of fragrance or mixtures of fragrance that may be used in the cleaning compositions of the present disclosure range from about 0.001% to about 10%, typically from about 0.001% to about 5% by weight, more typically about 0.001% to about 1%, even more typically 0.5% to 2%, such as about 0.6% to about 1.9%, including about 0.63% to about 0.68%, and yet even more typically about 0.8% to about 0.9% by weight of the cleaning composition.

Ionic Agent

In some implementations, the present cleaning composition contains one or more ionic agents. As used herein the term "ionic agent" refers to and includes any ionizable material or mixture of ionizable materials that undergo ionic dissociation in an aqueous composition to serve as an ion sources for stabilizing the solution, and control fragrance release and turbidity of the composition. Typically, ionic agents are ionic solids or liquids of various ionic compounds such as organic and inorganic electrolytes.

Suitable ionic agents for the cleaning compositions described herein include metal ions that can form an organic or inorganic salt which chlorides, hydroxides, phosphates, iminodisuccinates and/or citrates. Such metal ions include, for example, sodium, chloride, potassium and/or magnesium. In certain implementations, the suitable ionic agent of the cleaning compositions described herein may be selected from, for example, strongly ionizing salts, including metal alkali salts such as sodium chloride (NaCl), and acid salts such as sodium citrate (e.g., monosodium citrate, disodium citrate, trisodium citrate, or mixtures thereof).

The amount of ionic agent or the amount of the mixtures of ionic agents that may be used in the cleaning compositions of the present disclosure range from about 0.01% to about 0.5%, typically from about 0.1% to about 0.35% by weight, more typically about 0.2% to about 0.3.

Additional Ingredients

In various implementations, the compositions may further comprise additional ingredients, such as, for example, any other additives that are used in cleaning compositions, such as colorants, rheology modifiers, structuring agents, hydrotropes, whitening agents, reducing agents, enzymes, enzyme stabilizing agents, builders, bleaches, photobleaches, bleach catalysts, soil release agents, dye transfer inhibitors, buffers, soil repellents, water-resistance agents, suspending agents, aesthetic agents, preservatives and combinations thereof. An exemplary preservative may include isothiazolinone. These materials can be used in any desired amount.

In certain implementations, the cleaning compositions disclosed herein are aqueous compositions. The amount of water can be any amount. In certain implementations, the amount of water can be greater than 90% by weight of the composition, such as greater than 91%, greater than 92%, greater than 93%, or greater than 94% by weight of the composition. In certain implementations, the amount of water is about 95% by weight of the composition or greater than about 95% by weight of the composition, such as greater than about 96%, greater than about 97%, or ranging from about 90% to about 98%.

In some implementations, the compositions can be supplied as ready-to-use compositions. In other implementations, the cleaning composition is supplied as a concentrate that can later be diluted with water. The composition can be at least 2, at least 3, at least 4, or at least 5 times concentrated, in which case the amounts of materials are adjusted accordingly.

In some implementations, the ready-to-use compositions or the diluted compositions can be further diluted with water to any desired amount. In some implementations, the ready-to-use or diluted cleaning compositions of the present disclosure can be further diluted at least 2, at least 3, at least 4, at least 5 times, at least 10 times, at least 40 times, at least 70 times or at least 100 times.

Particle Size Distribution and Turbidity

In some implementations, the present cleaning compositions, including the diluted cleaning compositions, exhibit modified turbidity. Changes in the concentration of the ionic agent in the cleaning compositions described herein affects fragrance release and particle size distribution. In turn, changes in particle size distribution intensity affects turbidity. Any method known in the art for evaluating particle size distribution may be used to assess fragrance performance.

The cleaning composition including the anionic surfactants, such as a mixture of the LAS and SLES, the ionic agent, the nonionic surfactant and the fragrance has a turbidity amount of greater than about 10 NTU, for example a turbidity of from about 20 NTU to about 120 NTU, including a turbidity of from about 28 NTU to about 112 NTU Fragrance Performance In some implementations, the present cleaning compositions, including the diluted cleaning compositions, exhibit enhanced fragrance performance. As used herein "enhanced fragrance performance" means that the fragrance is quantitatively released from the present cleaning compositions in a greater amount, is perceived to be released in a greater amount and/or is released and/or is perceived to be released over a longer period of time in comparison to a standard, such as reference cleaning composition having the same formulation except for having a ratio of LAS:SLES and/or a total wt % of LAS and SLES outside of the ranges for the compositions described herein.

Any method known in the art for evaluating a fragrance may be used to assess fragrance performance. For example, to accurately determine the quantitative performance of the present cleaning compositions or dilutions of the present cleaning compositions, evaluating may include a headspace analysis performed using Solid Phase Micro Extraction ("SPME"). In brief, SPME essentially inserts a "trap" into the headspace vapor, typically a retentive coating applied to a narrow fused silica fiber, which collects compounds from the vapor as analytes. The fiber is typically attached to a stainless steel plunger in a protective holder. The collected analytes from the vapor are then thermally desorbed from the fiber and typically analyzed by a combination of gas chromatography (GC) and mass spectroscopy (MS). The GC separates the mixture into its individual components and the MS detects these components as they emerge from the end of the GC column. In MS, the analyte molecules are fragmented by a high energy stream of electrons which results in some analyte molecules ionized to a positive charge. The charged ions are then separated according to mass, counted and plotted versus intensity to provide a mass spectrum. Such a technique may be used to determine the amount or intensity of a fragrance released at various time points and these values may be compared to those of a standard, such as a reference cleaning composition, to assess the level of fragrance enhancement in the present cleaning compositions.

In other implementations, the perceived amount of fragrance release or duration of fragrance release of the present cleaning compositions may be evaluated by a trained fragrance expert or a panel of experts using, for example, a magnitude estimation scaling technique. For this evaluation, each panelist is asked to smell a sample of a cleaning composition and then to rate the fragrance intensity relative to a standard, such as a reference cleaning composition. All product scores may then be divided by the standard and given a magnitude estimation score. Then, the panelists' scores are averaged for each cleaning composition.

In other implementations, the panelists may be asked to rate the fragrance intensity over time. For example, the cleaning composition may be applied to a hard surface and the panelists may be asked to rate the fragrance intensity after the cleaning composition is first applied to the hard surface, and then to rate the fragrance intensity again after a given time period, e.g., after at least one hour, after at least two hours, after at least three hours, after at least four hours, after at least five hours or after six or more hours. In other implementations, the panelists may be asked to rate the fragrance intensity after the cleaning composition has been diluted. The values assigned to the present cleaning compositions can be compared with those of a standard, such as a reference cleaning composition, to assess the level of fragrance performance of the present cleaning compositions.

Without being limited by theory, the present cleaning compositions, which include amounts of anionic surfactants, such as LAS and SLES, in particular amounts and ratios as described herein, impact the stability of the micelles in the composition, resulting in enhanced fragrance performance. The stability of the micelles present in the instant cleaning compositions and the metastability of the micelles is evident in the present neat cleaning compositions and also upon dilution of the neat formulation in water and can be evaluated using methods known in the art and as described herein in the Example, e.g., SPME of the headspace analyzed using gas chromatography-mass spectrometry and/or evaluation by an expert fragrance evaluator. In some implementations, metastability of the micelles in diluted cleaning compositions may be evaluated by, for example, analyzing the turbidity of the present compositions. Turbidity analysis may be carried out by any well-known method, for example, using a HACH 2100Q Portable Turbidimeter.

Methods

The present disclosure is also directed to a method of preparing a cleaning composition with enhanced fragrance performance. In some implementations, the method includes combining at least two anionic surfactants, such as LAS and SLES, to form a mixture. The amounts and ratios of the at least two anionic surfactants used in the present methods are the same as previously described herein. Typically, about 1%-2% by weight of a combination of LAS and SLES is included in the mixture using a ratio of LAS to SLES of about 6:1 to about 1:1, such as about 3:1 to 1:1 or about 6:1 to 4:1. In some implementations, fragrance is added to the mixture. Typically, the fragrance is present in the cleaning composition in an amount as described above. In some implementations, at least one nonionic surfactant is added to the mixture. Typically, the nonionic surfactant is present in the composition in an amount as described above. In some implementations, at least one ionic agent is added to the mixture. Typically, the ionic agent is present in the composition in an amount as described above. In some implementations, fragrance and at least one ionic agent are added to the mixture. In some implementations, fragrance and at least one nonionic surfactant are added to the mixture. In some implementations, fragrance, at least one ionic agent, and at least one nonionic surfactant are added to the mixture. In various implementations, water and additional ingredients such as buffers, preservatives and coloring agents of the types and amounts described herein are also added to the mixture.

In other implementations, the cleaning compositions disclosed herein can be used to clean substrates by applying the composition to a substrate and optionally wiping the substrate. In certain implementations, the cleaning composition is formulated to be a bucket dilutable cleaner.

EXAMPLES

Example 1—Formula Composition

Comparative cleaning compositions (labeled C1, C2, C3 and C4) with varying wt/wt ratios of LAS to SLES but with no ionic agent were prepared and evaluated. The formulations of comparative cleaning compositions, C1-C4 are shown in Table 1A, below, with values expressed weight percent of the total composition (i.e., wt/wt %). Exemplary cleaning compositions (labeled E1, E2, E3 and E4) with varying wt/wt ratios of LAS to SLES and ionic agent were prepared and evaluated. The formulations of exemplary cleaning compositions, E1-E4 are shown in Table 1B, below, with values expressed weight percent of the total composition (i.e., wt/wt %). The same amount and type of fragrance was used in the following pairs of compositions: C1 and E1, C2 and E2, C3 and E3, and C4 and E4. The fragrance performance of each of the exemplary cleaning compositions was evaluated and compared with the corresponding comparative cleaning composition that contained the same fragrance and amount of fragrance.

TABLE 1A

| Material | C1 Ratio 4:1 | C2 Ratio 4.35:1 | C3 Ratio 4.2:1 | C4 Ratio 3.45:1 |
|---|---|---|---|---|
| Anionic Surfactant (Total LAS & SLES Combined) | 1%-2% | 1%-2% | 1%-2% | 1%-2% |
| Nonionic surfactant (C9-C11 Pareth 8) | >0% and <0.45% | >0% and <0.45% | >0% and <0.45% | >0% and <0.45% |
| Fragrance | 0.5%-2% | 0.5%-2% | 0.5%-2% | 0.5%-2% |
| Ionic Agent | 0% | 0% | 0% | 0% |
| Buffer | <0.5% | <0.5% | <0.5% | <0.5% |

TABLE 1A-continued

| Material | C1 Ratio 4:1 | C2 Ratio 4.35:1 | C3 Ratio 4.2:1 | C4 Ratio 3.45:1 |
|---|---|---|---|---|
| Color | <0.01% | <0.01% | <0.01% | <0.01% |
| Preservative | <0.1% | <0.1% | <0.1% | <0.1% |
| Water | Q.S. to 100% | Q.S. to 100% | Q.S. to 100% | Q.S. to 100% |

TABLE 1B

| Material | E1 Ratio 4:1 | E2 Ratio 4.35:1 | E3 Ratio 4.2:1 | E4 Ratio 3.45:1 |
|---|---|---|---|---|
| Anionic Surfactant Total LAS & SLES Combined | 1%-2% | 1%-2% | 1%-2% | 1%-2% |
| Nonionic surfactant (C9-C11 Pareth 8) | >0% and <0.45% | >0% and <0.45% | >0% and <0.45% | >0% and <0.45% |
| Fragrance | 0.5%-2% | 0.5%-2% | 0.5%-2% | 0.5%-2% |
| Ionic Agent | 0.01%-0.5% | 0.01%-0.5% | 0.01%-0.5% | 0.01%-0.5% |
| Buffer | <0.5% | <0.5% | <0.5% | <0.5% |
| Color | <0.01% | <0.01% | <0.01% | <0.01% |
| Preservative | <0.1% | <0.1% | <0.1% | <0.1% |
| Water | Q.S. to 100% | Q.S. to 100% | Q.S. to 100% | Q.S. to 100% |

Example 2—Fragrance Release and Turbidity Evaluation

The fragrance intensity of each of the comparative and exemplary cleaning compositions was evaluated initially and over time in order to assess the fragrance performance of each of the cleaning compositions. One of two fragrances (a more hydrophobic fragrance or a less hydrophobic (more hydrophilic) fragrance) at one of two amounts (a "high" amount and a "low" amount within the range of 0.5% to 2% fragrance level) was selected for use in each of the comparative and exemplary compositions. Several 4"×4" tile surfaces were treated using a 2.5% dilution of 580 μL volumes the comparative and exemplary cleaning compositions C1-C4 and E1-E4, respectively. Paper towel was used to spread the volume of the cleaning compositions on the tiles. The tiles were then placed in a glass chamber and a headspace analysis was performed using SPME. Collected analytes were then thermally desorbed for about 5 minutes and analyzed by GCMS An example of the fragrance intensity profiles for comparative cleaning compositions C1-C4 and exemplary cleaning compositions E1-E4 along with corresponding measured turbidity values are shown in Table 2 below:

TABLE 2

| Composition | Ionic Agent | Fragrance Type | Fragrance Level | Fragrance Release by Head Space (Total Chromatogram Area) 8 = Highest Measured Result 1 = Lowest Measured Result: Direct Injection | SPME | Turbidity (NTU) |
|---|---|---|---|---|---|---|
| C1 | 0% | 1 | 0.63% | 6 | 7 | 0.41 |
| C2 | 0% | 1 | 0.68% | 4 | 6 | 0.85 |
| C3 | 0% | 2 | 0.63% | 8 | 8 | 0.64 |
| C4 | 0% | 2 | 0.68% | 7 | 5 | 1.88 |
| E1 | 0.01%-0.5% | 1 | 0.63% | 1 | 4 | 28.7 |
| E2 | 0.01%-0.5% | 1 | 0.68% | 2 | 2 | 63.7 |
| E3 | 0.01%-0.5% | 2 | 0.63% | 3 | 3 | 41.4 |
| E4 | 0.01%-0.5% | 2 | 0.68% | 5 | 1 | 112 |

As is evident from Table 2, the fragrance release properties can be enhanced by the presence of anionic surfactants, such as a mixture of LAS:SLES and is further impacted as turbidity is modified by the addition of an ionic agent in amount selected within the range described for the compositions herein. Accordingly, as is evident from the data shown in Table 2, the fragrance release of the present cleaning compositions over time are impacted by the level and ratio of LAS and SLES as well as the amount of ionic agent used to modify the turbidity of the present cleaning compositions. Specifically, the fragrance release rankings indicate that in some instances, a composition having lower concentration of fragrance, such as 0.63%, can achieve same or higher fragrance release than the compositions having higher concentration of fragrance, such as 0.68%, for example, at a given ratio of LAS:SLES and given amount of Alcohol EO. Additionally, across compositions having equivalent ratios of LAS:SLES, it is evident from the results in table 2 that fragrance release is also reduced by the addition of ionic agent, such as 0.25% NaCl although turbidity was shown to increase.

Example 3—Particle Size Distribution Evaluation

Change in particle size distribution due to the addition of an ionic agent in cleaning compositions was evaluated and compared for different cleaning compositions. Specifically, particle size distribution and was monitored for each of two different compositions having different turbidities. Particle size was measured in a Malvern Zetasizer Nano ZS ZEN3600 particle characterization system with results reported below in Table 3.

TABLE 3

| | | Composition Formulation | | | | | | | |
|---|---|---|---|---|---|---|---|---|---|
| | | C4 | | | | E4 | | | |
| | | Appearance | | | | | | | |
| | | Clear | | | | Turbid | | | |
| | | NTU before Dilution | | | | | | | |
| | | 1.05 | | | | 38.2 | | | |
| | | Ionic Agent | | | | | | | |
| | | N/A | | | | Added | | | |
| Sample | | Peak 1 | Peak 2 | Peak 3 | Z-Avg. (d · nm) | Peak 1 | Peak 2 | Peak 3 | Z-Avg. (d · nm) |
| Neat | Particle Size (d · nm) | 5.72 | 3889 | 0 | 5.2 | 149.4 | 7.25 | 4495 | 86.7 |
| | % intesity | 97.1 | 2.9 | 0 | | 88.7 | 8.8 | 2.5 | |
| Diluted 2.0% in tap water | Particle Size (d · nm) | 5.48 | 229.3 | 4733 | 7.4 | 41.8 | 230.2 | 5535 | 63.3 |
| | % intesity | 75.3 | 22.7 | 2 | | 68.8 | 30.1 | 1.1 | |

What is claimed is:

1. A cleaning composition consisting of:

at least two anionic surfactants, wherein the at least two anionic surfactants comprise a linear alkylbenzene sulfonate (LAS) and a sodium lauryl ether sulfate (SLES), wherein the LAS and the SLES are present in the cleaning composition in a total amount combined of 0.8%-1.5% by weight and wherein a weight ratio of LAS:SLES is about 3.45:1 to about 4.35:1;

an ionic agent in an amount of 0.2% to 0.3% by weight, wherein the ionic agent comprises an alkali metal salt or an acid salt;

a nonionic surfactant $C_9$-$C_{11}$ alkanol condensed with 2.5 to 10 moles of ethylene oxide in an amount of greater than about 0% to less than about 0.45% by weight;

a fragrance in an amount of about 0.001% to about 0.63% by weight and one or more optional ingredients selected from water, colorant, buffer, and preservative.

2. The cleaning composition of claim 1, wherein the cleaning composition is a bucket-dilutable cleaning composition.

3. The cleaning composition of claim 1, wherein the LAS:SLES ratio is about 3:1.

4. The cleaning composition of claim 1, wherein the nonionic surfactant is C9-C11 Pareth 8.

5. The cleaning composition of claim 1, wherein the cleaning composition has a turbidity of greater than 10 NTU.

6. The cleaning composition of claim 1, wherein the ionic agent comprises sodium chloride.

7. The cleaning composition of claim 1, wherein the ionic agent comprises sodium citrate.

8. A method of preparing a cleaning composition of claim 1 with enhanced fragrance performance, the method comprising:

combining at least two anionic surfactants, wherein the at least two anionic surfactants comprise a linear alkylbenzene sulfonate (LAS) and a sodium lauryl ether sulfate (SLES), to form a mixture having a weight ratio of LAS:SLES of about 3.45:1 to about 4.35:1; and adding the mixture, an ionic agent and a nonionic surfactant $C_9$-$C_{11}$ alkanol condensed with 2.5 to 10 moles of ethylene oxide to the cleaning composition, wherein the cleaning composition includes a fragrance in an amount of 0.001% to 0.63% by weight, wherein the ionic agent comprises an alkali metal salt or an acid salt;

wherein the mixture comprises a total amount combined of LAS and SLES of 0.8%-1.5% by weight of the cleaning composition, and wherein the ionic agent comprises an amount of 0.2% to 0.3% by weight and the nonionic surfactant comprises an amount of greater than about 0% to less than about 0.45% by weight of the cleaning composition.

9. The method of claim 8, wherein the nonionic surfactant is C9-C11 Pareth 8.

10. The method of claim 8, wherein the cleaning composition has a turbidity of greater than 10 NTU.

11. The method of claim 8, wherein the cleaning composition is a bucket-dilutable cleaning composition.

12. A method of cleaning a substrate, the method comprising:

applying the cleaning composition of claim 1 to the substrate; and wiping the cleaning composition across the substrate.

13. The method of claim 12, wherein the cleaning composition is a bucket-dilutable cleaner.

* * * * *